US005536391A

United States Patent [19]

Howley et al.

[11] Patent Number: 5,536,391

[45] Date of Patent: Jul. 16, 1996

[54] PRODUCTION OF CLEAN DISTILLATE FUELS FROM HEAVY CYCLE OILS

[76] Inventors: Paul A. Howley, 301 N. Feathering Rd., Media, Pa. 19063; Gregory A. Jablonski, 1395 Heller Dr., Yardley, Pa. 19067; L. Deane Rollmann, 211 S. Washington Ave., Morrestown, N.J. 08057; Hye K. C. Timken, 44 N. Gerard St., Woodbury, N.J. 08096

[21] Appl. No.: 373,827

[22] Filed: Jan. 17, 1995

[51] Int. Cl.[6] ..... C10G 65/14

[52] U.S. Cl. ..... 208/80; 208/78

[58] Field of Search ..... 208/78, 80

[56] References Cited

U.S. PATENT DOCUMENTS

| | | | |
|---|---|---|---|
| 3,157,589 | 11/1964 | Scott et al. | 208/80 |
| 3,364,134 | 1/1968 | Hamblin | 208/80 |
| 3,941,680 | 3/1976 | Bryson et al. | 208/80 |
| 3,957,625 | 5/1976 | Orkin | 208/211 |
| 4,789,457 | 12/1988 | Fischer et al. | 208/68 |
| 4,990,242 | 2/1991 | Louie | 208/218 |
| 5,011,593 | 4/1991 | Ware et al. | 208/213 |
| 5,203,987 | 4/1993 | de la Fuente | 208/80 |

*Primary Examiner*—Helane Myers

*Attorney, Agent, or Firm*—Ronald A. Bleeker; Malcolm D. Keen; Penny L. Prater

[57] ABSTRACT

This invention discloses an enhanced process for the hydroprocessing of a feed, the feed comprising a highly aromatic refinery distillate stream boiling in the range between 300° and 900° F. The feed is separated into light and heavy streams such that the light stream contains from 0.1 to 5 wt. % dibenzothiophene, substituted dibenzothiophenes, and heavier polycyclic thiophenes. The lighter stream is hydrotreated at pressures from 300° to 1000° F. with a commercial catalyst having a hydrogenation component. The heavier stream is treated in the presence of hydrogen at higher pressure, from 600 to 2000 psig with a catalyst comprising active material having a Constraint Index of less than 2 in addition to a hydrogenation component in order to achieve over 35% conversion of material boiling above 630° F. The active material of the catalyst is a highly siliceous zeolite or an acidic amorphous silica-alumina material.

19 Claims, No Drawings

PRODUCTION OF CLEAN DISTILLATE FUELS FROM HEAVY CYCLE OILS

FIELD OF THE INVENTION

This invention relates to the hydroprocessing of highly aromatic refinery distillate streams, for manufacturing clean jet and diesel fuels as well as gasolines. More particularly, this invention relates to a process comprising segregation of distinct portions of such streams and a plurality of hydroprocessing zones operating at distinct operating conditions.

BACKGROUND OF THE INVENTION

In order to remain competitive, refiners have continuously sought to improve the quality of middle distillate products while simultaneously reducing processing costs. Refiners have recently sought to maximize existing equipment to achieve desired upgrades rather than build new equipment, in order to control costs. Such maximization is a continual challenge to refiners, since refining stocks have become heavier and poorer in quality. Upgrading capacity has been further strained by more stringent mandates on emissions.

FCC cycle oil is a feed commonly used for the production of middle distillates and automotive diesel fuel. FCC cycle oil is a broad cut boiling between about 300° F. and 900° F. In addition to paraffins and cyclo paraffins, it contains both two and three ring aromatic structures and thiophenes. The thiophenes are generally multiple ring structures, such as benzothiophene, dibenzothiophene, substituted benzothiophenes and substituted dibenzothiophenes.

Combined processing of both heavy and light portions of FCC cycle oil negatively affects hydroprocessing operations, such as catalytic hydrodesulfurization (CHD) and hydrocracking (HDC), including pressure requirements, flow rates, temperatures, product quality, and product yields. Operating conditions are generally dictated by the larger structures and are excessively severe for the lighter portion, which contains the smaller molecular structures. Catalysts tend to age relatively quickly when employed under excessively severe operating conditions, also.

Zeolites have not been employed frequently as the support in commercial catalysts for mild hydroprocessing for heteratom removal and bond saturation (such as CHD), either on their own or combined with an amorphous matrix such as alumina because they tend to have a greater activity than alumina or other commonly used supports. With activity increase there is a concommitant increase in boiling range conversion and reduction in distillate yield. In addition, acidic zeolites are subject to coke formation and rapid aging under mild hydroprocessing conditions with feeds boiling above about 550° F.

Zeolites, especially zeolites X and Y, have long been used in more severe hydroprocessing operations such as hydrocracking, where their relatively greater activity is an asset. Under hydrocracking conditions they have excellent resistance to aging, particularly the more highly siliceous forms of zeolite Y, such as "ultra-stable" or USY.

There are regulations throughout the world on the permissible quantity of sulfur in distillate products. The Environmental Protection Agency (EPA) and state environmental agencies, such as the California Air Resources Board (CARB) have established maximum standards of 0.05 wt % sulfur, for example. These standards went into effect in 1994.

Various means have been proposed to upgrade feeds of high aromatic content. U.S. Pat. No. 4,789,457 discloses the recycling of full range cycle oils or cycle oil fractions to a catalytic cracking unit, where such feeds are subjected to low pressure hydrocracking in order to maximize the production of high octane gasoline.

In order to avoid aging, conversion should be limited when operating with full range light cycle oil, and lower boiling fractions are preferred. U.S. Pat. No. 5,011,593 discloses the treating of full range cycle oils (boiling in the range of 385°–750° F.) or fractions thereof by catalytic hydrodesulfurization employing zeolite beta and a hydrogenation component.

U.S. Pat. No. 3,957,625 discloses that sulfur impurities tend to concentrate in the heavier portion of a product fraction. It proposes a method of removing the sulfur from catalytically cracked gasoline by hydrodesulfurization of the heavy portion of the gasoline. The octane contribution of the olefins found in the lighter fraction is therefore retained. The light and heavy gasoline fractions are then recombined following separate treating.

U.S. Pat. No. 4,990,242 is concerned with enhanced removal of sulfur from fuels. This patent discloses the fractionation of a feedstock and the separate removal of sulfur from the lighter fraction. On splitting the full range cycle oil at 570°–575° F. and separately hydrotreating the two fractions, the light portion attains a sulfur level below the 0.05 wt. % S standard. When combined with the separately hydrotreated heavy fraction, however, the standard is not met.

SUMMARY OF THE INVENTION

In conventional refinery operation, broad boiling streams with an aromatic content greater than 40%, such as FCC cycle oil, are hydroprocessed, usually in either a hydrodesulfurization (CHD) or hydrocracking (HDC) unit. In the instant invention the heavier portion of such a stream, which boils between about 600° and about 900° F. is separately processed over a catalyst or catalyst mixture comprising at least one highly siliceous zeolite or acidic amorphous silica-alumina having at least one hydrogenation component. The specific combination of zeolites and hydrogenation components is determined by the sulfur, nitrogen, aromatics and n-paraffin content of the feed and by the desired product slate.

Separate processing of the heavy stream results in significant benefits in desulfurization effectiveness (thereby enabling governmental specifications to be met), in kerosene, diesel and gasoline product yield, in refinery operating cost and in some instances capital investment.

DETAILED DESCRIPTION OF THE INVENTION

Feedstock

The feeds used in the present process are hydrocarbon fractions which are highly aromatic and hydrogen deficient. They are fractions which have an aromatic content in excess of at least 40 wt. percent and often 60 wt. percent or 80 wt. percent or more. Highly aromatic feeds of this type typically have hydrogen contents below 14 wt. percent, usually below 12.5 wt. percent or even lower, e.g. 8–10 wt. percent or 8–9 wt. percent. The API gravity is often a measure of the aromaticity of the feed, usually being below 30 and in most cases below 25 or even lower, e.g. below 20. In most cases the API gravity will be in the range 5 to 25 e.g. 5–15, with corresponding hydrogen contents from 8.5–12.5 wt. percent. Sulfur contents are typically from 0.5–5 wt. percent and nitrogen from 50–3000 ppmw, more usually 100–1000 ppmw.

The feeds of this type which are especially useful in the present process are the dealkylated cycle oil fractions produced by catalytic cracking operations, for example, in an FCC or TCC unit. A characteristic of catalytic cracking is that the alkyl groups, generally bulky, relatively large alkyl groups (typically but not exclusively $C_5$–$C_9$ alkyls), which are attached to aromatic moieties in the feed become removed during the course of the cracking. It is these detached alkyl groups which contribute to the gasoline fraction produced from the cracker. Aromatic moieties such as naphthalenes, benzothiophenes, dibenzothiophenes and polynuclear aromatics (PNAs) such as anthracene and phenanthrene are among the high boiling products from the cracker. The mechanisms of acid-catalyzed cracking and similar reactions remove side chains of greater than 5 carbons while leaving behind short chain alkyl groups, primarily methyl, but also ethyl groups on the aromatic moieties. Thus, the "substantially dealkylated" cracking products include those aromatics with small alkyl groups, such as methyl, and ethyl, and the like still remaining as side chains, but with relatively few large alkyl groups, i.e., the $C_5$–$C_9$ groups, remaining. More than one of these short chain alkyl groups may be present, for example, one, two or more methyl groups.

Cycle oil feeds include full range cycle oils which typically have a boiling range within the range of about 300°–900° F. and preferably in the range of about 350°–800° F. Fractionation of a full range cycle oil or adjustment of the cut points on the cracker fractionation column may be used to obtain two portions of cycle oil. The lower end temperature of the lighter fraction may be as low as 300° F., preferably between about 320° and 350° F., and possibly as high as 400° F., and the top end temperature of the lighter fraction may range from about 500° F. to about 700° F., preferably from about 550° to 675° F. and most preferably from 600° to 650° F. The heavier fraction will boil generally in the range above the top temperature of the lower fraction, but below about 900° F. and preferably below between about 750° and 850° F. It will be understood that some portion of the lighter fraction will carry over into the heavier fraction in any commercial distillation process. The precise temperature of the split will depend on the total sulfur content, the relative amounts of benzothiophenes, substituted benzothiophenes, dibenzothiophene, substituted dibenzothiophenes, and heavier polycyclic thiophenes present in the cycle oil, the desired product slate from the refinery, and the operating capabilities of the available hydroprocessing equipment. In general, the greater the sulfur content of a full range cycle oil and the higher the percentage of dibenzothiophenes, substituted dibenzothiophenes, and heavier polycyclic thiophenes, the lower the preferred temperature will be for the split. When a 0.3% S light product is desired, for example, the temperature will be chosen such that the light fraction contains no more than 5 wt. % and preferably less than 3 wt. % of dibenzothiophenes, substituted dibenzothiophenes and heavier polycyclic thiophenes. When a 0.05% S light product is desired, the temperature for the split will be chosen such that the light fraction contains less than 1 wt. % and preferably less than 0.5 wt. % of dibenzothiophenes, substituted dibenzothiophenes and heavier polycyclic thiophenes.

It will thus be understood that an optimum content of dibenzothiophene, substituted dibenzothiophenes, and heavier polycyclic thiophenes in the light fraction will exist, in relation to the desired light product sulfur level. For products currently envisioned, the optimum content will be between about 0.1 and 5 wt. %, preferably from 0.1 to 2 wt. %.

Catalyst

The catalysts used in the processing of the lighter portion of the cycle oil are of a conventional nature. Without being limited to any particular catalyst, typical catalysts are in the form of extrudates and include molybdenum on alumina, cobalt molybdate on alumina, nickel molybdate on alumina, nickel tungstate or combinations thereof. Catalyst choice may depend on the particular application. Cobalt molybdate catalyst is generally used when sulfur removal is the primary interest. The nickel catalysts find application in the treating of cracked stocks for olefin or aromatic saturation. The preparation of these catalysts is now well known in the art.

The catalysts used for hydroprocessing the heavier portion of the cycle oil comprise highly siliceous zeolites or acidic amorphous silica-alumina materials as active components. They are bifunctional, heterogenous, porous solid catalysts which possess both acidic and hydrogenation functionality. Because the aromatic feeds contain relatively bulky bicyclic and tricyclic aromatic components the catalyst is required to have a pore size which is sufficiently large to admit these materials to the interior structure of the catalyst where the acid-catalyzed ring opening reactions can take place in order to effect removal of the heteroatoms under deep desulfurization conditions. Zeolite beta possesses a pore size of the requisite magnitude provided by the twelve-membered ring system. Zeolite beta is a known zeolite and is described in U.S. Pat. No. 3,308,069 (Wadlinger) to which reference is made for a description of this catalyst, its properties and preparation. Its use in catalytic dewaxing processes is described in U.S. Pat. No. 4,419,220 to which reference is also made for a further description of this catalyst and its use in dewaxing processes.

Acidity in a potential zeolite or amorphous silica-alumina suitable for use in this invention can be conveniently measured by the alpha test. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant =0.016 sec −1). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 6.1, 395 (1980). In general, acidic materials useful in this invention will have an alpha of at least 1, preferably at least 5, and most preferably 10 or above.

As indicated above, the preferred catalysts of this invention comprise either highly siliceous zeolites or an amorphous silica-alumina material having an acidic functionality. The latter materials are well-known in the hydroprocessing art. If the zeolite desired may be produced in the desired highly siliceous form by direct synthesis, this is often the most convenient method for obtaining it. Zeolite beta, for example, is known to be capable of being synthesized directly in forms having silica:alumina ratios up to 100:1, as described in U.S. Pat. Nos. 3,308,069 and Re 28,341 which describe zeolite beta, its preparation and properties in detail. Even higher silica:alumina ratios are possible, as would be recognized by those skilled in the art. Zeolite Y, on the other hand, can be synthesized readily only in forms which have silica:alumina ratios up to about 5:1. In order to achieve higher ratios, various techniques may be employed to remove structural aluminum so as to obtain a more highly siliceous zeolite. The same is true of mordenite which, in its natural or directly synthesized form has a silica:alumina ratio of about 10:1. Zeolite ZSM-20 may be directly synthesized with silica:alumina ratios of 7:1 or higher, typically in the range of 7:1 to 10:1, as described in U.S. Pat. Nos. 3,972,983 and 4,021,331. Zeolite ZSM-20 also may be treated by various methods to increase its silica:alumina ratio. In general, any zeolite or amorphous silica-alumina material having an acidic functionality which exhibits a Constraint Index below 2.0 can be considered for this invention. The method by which Constraint Index is determined is described fully in U.S. Pat. No. 4,016,218, incorporated herein by reference for details of the method. Constraint Index (CI) values for typical zeolites which are suitable as catalysts in the process of this invention are as follows:

| | CI (at test temperature) |
|---|---|
| ZSM-4 | 0.5 (316° C.) |
| MCM-22 | 0.6–1.5 (399° F.–454° C.) |
| TEA Mordenite | 0.4 (316° C.) |
| REY | 0.4 (316° C.) |
| Amorphous Silica-alumina | 0.6 (538° C.) |
| Dealuminized Y | 0.5 (510° C.) |
| Zeolite Beta | 0.6–2.0 (316° C.–399° C.) |
| ZSM-20 | 0.5 (371° C.) |
| Mordenite | 0.5 (316° C.) |

Control of the silica:alumina ratio to the zeolite in its as-synthesized form may be exercised by an appropriate selection of the relative proportions of the starting materials, especially the silica and alumina precursors, a relatively smaller quantity of the alumina precursor resulting in a higher silica:alumina ratio in the product zeolite, up to the limit of the synthetic procedure. If higher ratios are desired and alternative synthesis affording the desired high silica:alumina ratios are not available, other techniques such as those described below may be used in order to prepare the desired highly siliceous zeolites.

The silica:alumina ratios referred to in this specification are the structural or framework ratios. This is the ratio for the $SiO_4$ to the $AlO_4$ tetrahedra which together constitute the structure of which the zeolite is composed. This ratio may vary from the silica:alumina ratio determined by various physical and chemical methods. For example, a gross chemical analysis may include aluminum which is present in the form of cations associated with the acidic sites on the zeolite, thereby giving a low silica:alumina ratio. Similarly, if the ratio is determined by thermogravimetric analysis (TGA) of ammonia desorption, a low ammonia titration may be obtained if cationic aluminum prevents exchange of the ammonium ions onto the acidic sites. These disparities are particularly troublesome when certain treatments such as the dealuminization methods described below which result in the presence of ionic aluminum free of the zeolite structure are employed. Care should therefore be taken to ensure that the framework silica:alumina ratio is correctly determined.

A number of different methods are known for increasing the structural silica:alumina ratio of various zeolites. Many of these methods rely upon the removal of aluminum from the structural framework of the zeolite by chemical agents appropriate to this end. A considerable amount of work on the preparation of aluminum deficient faujasites has been performed and is reviewed in Advances in Chemistry Ser. No. 121, Molecular Sieves, G. T. Kerr, American Chemical Society, 1973. Specific methods for preparing dealuminized zeolites are described in the following, and reference is made to them for details of the method: Catalysis by Zeolites (International Symposium on Zeolites, Lyon, Sept. 9–11, 1980), Elsevier Scientific Publishing Co., Amsterdam, 1980 (dealuminization of zeolite Y with silicon tetrachloride); U.S. Pat. No. 3,442,795 and G. B. Pat. No. 1,058,188 (hydrolysis and removal of aluminum by chelation); G. B. Pat. No. 1,061,847 (acid extraction of aluminum); U.S. Pat. No. 3,493,519 (aluminum removal by steaming and chelation): U.S. Pat. No. 3,591,488 (aluminum removal by steaming); U.S. Pat. No. 4,273,753 (dealuminization by silicon halides and oxyhlides); U.S. Pat. No. 3,691,099 (aluminum extraction with acids); U.S. Pat. No. 4,093,560 (dealumination by treatment with salts); U.S. Pat. No. 3,937,791 (aluminum removal with Cr(III) solutions); U.S. Pat. No. 3,506,400 (steaming followed by chelation); U.S. Pat. No. 3,640,681 (extraction of aluminum with acetyl-acetonate followed by dehydroxylation): U.S. Pat. No. 3,836,561 (removal of aluminum with acid); DE-OS Pat. No. 2,510,740 (treatment of zeolite with chlorine or chlorine-contrary gases at high temperatures), N.L. Pat. No. 7,604,264 (acid extraction), JA Pat. No. 53,101,003 (treatment with EDTA or other materials to remove aluminum) and J. Catalysis 54 295 (1978) (hydrothermal treatment followed by acid extraction).

Because of their convenience and practicality, the preferred dealuminization methods for preparing the present highly siliceous zeolites are those which rely upon acid extraction of the aluminum from the zeolite. Zeolite beta may be dealuminized by acid extraction using mineral acids such as hydrochloric acid. Highly siliceous forms of zeolite Y may be prepared by steaming or by acid extraction of structural aluminum (or both). Because zeolite Y in its normal, as-synthesized conditions, is unstable to acid, it must first be converted to an acid-stable form. Methods for doing this are known and one of the most common forms of acid-resistant zeolite Y is known as "Ultrastable Y" (USY). USY is described in U.S. Pat. Nos. 3,293,192 and 3,402,996 and the publication, Society of Chemical Engineering (London) Monograph Molecular Sieves, page 186 (1968) by C. V. McDaniel and P. K. Maher. Reference is made to these for details of the zeolite and its preparation. In general, "ultrastable" refers to Y-type zeolite which is highly resistant to degradation of crystallinity by high temperature and steam treatment and is characterized by a $R_2O$ content (wherein R is Na, K or any other alkali metal ion) of less than 4 weight percent, preferably less than 1 weight percent, and a unit cell size less than 24.5 Angstroms and a framework silica:alumina ratio above about 5, e.g., ratios of 15, 50 or 200 or more. The ultrastable form of Y-type zeolite is obtained primarily by a substantial reduction of the alkali metal ions and the unit cell size reduction of the alkali metal ions and the unit cell size reduction. The ultrastable zeolite is identified both by the smaller unit cell and the low alkali metal content in the crystal structure.

The ultrastable form of the Y-type zeolite can be prepared by successively base exchanging a Y-type zeolite with an aqueous solution of an ammonium salt, such as ammonium nitrate, until the alkali metal content of the Y-type zeolite is reduced to less than 4 weight percent. The base exchanged zeolite is then calcined at a temperature of 540° C. to 800°

C. for up to several hours, cooled and successively base exchanged with an aqueous solution of an ammonium salt until the alkali metal content is reduced to less than 1 weight percent, followed by washing and calcination again at a temperature of 540° C. to 800° C. to produce an ultrastable zeolite Y. The sequence of ion exchange and heat treatment results in the substantial reduction of the alkali metal content of the original zeolite and results in a unit cell shrinkage which is believed to lead to the ultra high stability of the resulting Y-type zeolite.

The ultrastable zeolite Y may then be extracted with acid to produce a highly siliceous form of the zeolite.

Other methods for increasing the silica:alumina ratio of zeolite Y by acid extraction are described in U.S. Pat. Nos. 4,218,307, 3,591,488 and 3,691,099, to which reference is made for details of these methods.

In addition to the highly siliceous zeolite or acidic amorphous silica-alumina having a Constraint Index below 2, the catalyst or catalysts used in this mixture may also contain a binder. The binder is typically an amorphous inorganic oxide material such as alumina, silica-alumina or silica and this binder may comprise from about 20 to 80 percent, and preferably 40 to 60 percent of the catalyst (excluding metal hydrogenation component). Because the zeolite or acidic amorphous silica-alumina provides the desired acidic functionality to the catalyst, the matrix, if present, may be essentially non-acidic. Non-selective active material conversion during the process is thus maintained at a desirably low level. A further description of suitable matrix materials and of compositing methods may be found in U.S. Pat. No. 4,789,457 (Fischer) to which reference is made for such a description.

The catalysts of this invention which comprise an active material also have a metal component to provide the necessary hydrogenation functionality. Suitable hydrogenation components include the metals of Groups VIA and VIIIA of the Periodic Table (IUPAC Table) specifically tungsten, vanadium, zinc, molybdenum, rhenium, nickel, cobalt, chromium or manganese. The hydrogenation component is generally present in an amount between 0.1 and about 25 wt %, normally 0.1 to 5 wt %, especially for noble metals, and preferably 0.3 to 3 wt %. This component can be exchanged or impregnated into the composition, using a suitable compound of the metal. The compounds used for incorporating the metal component into the catalyst can usually be divided into compounds in which the metal is present in the cation of the compound and compounds in which it is present in the anion of the compound. Compounds which contain the metal as a neutral complex may also be employed. The compounds which contain the metal in the ionic state are generally used, although cationic forms of the metal have the advantage that they will exchange onto the active material. Anionic complex ions such as vanadate or metatungstate which are commonly employed can however be impregnated onto the zeolite/-binder composite without difficulty in the conventional manner since the binder is able to absorb the anions physically on its porous structure. Higher proportions of binder will enable higher amounts of these complex ions to be impregnated. Base metal components, especially cobalt either alone or with molybdenum, or nickel either alone or mixed with tungsten or molybdenum are particularly preferred in the present process.

As indicated previously, hydroprocessing catalysts of the instant invention comprise preferably large pore, highly siliceous zeolites such as zeolite beta and USY. Base metal components, especially cobalt either alone or with molybdenum, or nickel either alone or mixed with tungsten or molybdenum are particularly preferred in the present process. They may be used however in conjunction with amorphous catalysts such Co/Mo on alumina.

PROCESS CONDITIONS

In this invention, mild and conventional hydrotreating conditions, suitable for the removal of heteroatoms such as S, N and O, are appropriate for processing the lighter portion of the cycle oil. Thus total pressures will normally be in the range of 300–1000 psig, preferably 400–600 psig, hydrogen circulation rates will be 500–6000 SCF/B, preferably 1000–2000 SCF/B, temperatures will be 400°–800° F., preferably 500°–700° F., and WHSV will be from about 0.5 to 6 $hr^{-1}$ preferably from 1 to 4.

Conditions in the hydroprocessing of the heavier portion of the cycle oil (involving the use of the catalyst comprising the active material) are more severe. Total pressure will be between about 600 and 2000 psig, preferably 900 to 1500 psig, hydrogen circulation rates will be 1000–8000 SCF/B, preferably 2000–5000, temperatures will be 500°–800° F., preferably 600–750, and WHSV will be from about 0 5 to 6 $hr^{-1}$, preferably from 1 to 4.

Precise operating conditions will be selected on the basis of desired product slate, sulfur and aromatics specifications, if any, and available refinery hydroprocessing equipment. Products containing less than 0.05 wt. % S can be made under the conditions of this invention, if desired.

EXAMPLES

Example 1

This example demonstrates the disadvantage of hydroprocessing full range cycle oil and the particular care which must be taken in choosing the cutpoint temperature in segregating a full range cycle oil into light and heavy portions.

The feed is a light portion of cycle oil which boils between about 300° to 650° F. and contains 2.1% S and 74% aromatics. The cutpoint for its separation from full range cycle oil is 575° F. It contains 0.6% dibenzothiophene, substituted dibenzothiophenes, and heavier polycyclic thiophenes.

When this feed is processed over a commercial NiMo/alumina catalyst at 568° F., 2.6 WHSV, 900 psig, and 6000 SCF/B hydrogen, a liquid product is obtained which contains 0.10% S and does not meet a 0.05% S automotive diesel fuel specification.

When the experiment is repeated with a feed which boils between 300° and 630° F. and contains approximately 0.1% dibenzothiophene and substituted dibenzothiophenes, the liquid product meets the 0.05% S specification. The cutpoint for separating this light portion of cycle oil is 550° F.

Cutpoint in the separation of light and heavy portions of the cycle oil may thus be tailored, based on the dibenzothiophene and substituted dibenzothiophene content of the light portion, to meet a desired light product sulfur specification and to accommodate available hydroprocessing equipment. It will also be appreciated by those skilled in the art, that an optimum cutpoint will exist.

Example 2

This example shows that only a minor amount of the heavy portion of a cycle oil can be converted to distillate boiling below 600° F. and meeting a 0.05% S specification by a catalyst which contains only a hydrogenation component.

The feed is a heavy portion of a cycle oil and boils between about 560° and 800° F. It contains 2.8% S, virtually all of it in the form of dibenzothiophene, substituted dibenzothiophenes, and heavier polycyclic thiophenes. It contains 74% aromatics.

When this feed is processed over the same commercial NiMo/alumina catalyst as in Example 1, but at 900 psig, 6000 SCF/B hydrogen, 1 to 3 WHSV, and at temperatures ranging from 550° to 800° F., a limit of about 35% is reached in the conversion of material boiling above about 630° F. to lighter hydrocarbons. Selectivity to 420°–630° F. distillate is 86%.

Example 3

This example shows that the limitation on conversion of material boiling above 630° F. is lifted and that selectivity to 420°–630° F. distillate in some cases increases when highly siliceous zeolite is included in the catalyst as the active material.

The feed is the heavy portion of a cycle oil and boils between 590° and 815° F. It contains 3.7% S, 1500 ppm N, and 78% aromatics.

When this feed is processed under the conditions of Example 2 at 1.1 WHSV over a commercial NiMo/USY catalyst (the catalyst containing approximately 40% of USY zeolite and the USY having a unit cell parameter of 24.3Å), conversion of material boiling above 630° F. increases steadily with increasing temperature, namely, from 39% at 701° F. to 45% at 722° F. and to 60% at 753° F. Selectivity for 420°–620° F. distillate is 91% at 701° F., 83% at 722° F., and 64% at 753° F. The enhanced selectivity is attributed to a zeolite-induced partial breakdown of high boiling three-ring aromatics, to yield distillate range two-ring structures. Much of the material boiling below 420° F. is low-sulfur gasoline. It will be understood that material boiling above 630° F. may be recycled to extinction if so desired.

Example 4

This example supports the assertion in Example 3 that high boiling three-ring structures are yielding 420°–630° F. distillate in the presence of zeolite.

The experiment of Example 3 is repeated at 753° F., but with a feed containing 7.5% phenanthrene, a three-ring aromatic which boils at 640° F. Under these conditions, conversion of material boiling above 630° F. is 61%, vs 60% for feed at the same conditions without the phenanthrene present (see Example 3). Selectivity to 420°–630° F. distillate is 72%, vs 64% in Example 3.

Example 5

This example illustrates even higher conversion than in Example 3 when a heavy portion is hydrotreated to reduce S and N levels before contact with zeolite. It will be appreciated by those skilled in the art of distillation that commercial hydrotreating of the heavy portion will require conditions not unlike those preferred for hydroprocessing of this material.

The feed is the same as in Example 3 except that it has been hydrotreated with a commercial hydrotreating catalyst which contains 3% Ni and 13% Mo to achieve a sulfur content of 0.32% and a nitrogen content of 760 ppm. When this feed is processed at 755° F. under the same conditions as in Example 3, 71% of the material boiling above 630° F. is converted and the selectivity to 420°–630° F. distillate is 68%. The product liquid contains 0.002% S. Here, too, it is recognized that the material boiling above 630° F. may be recycled to extinction over the hydrotreating and hydroprocessing sequence of catalysts.

Example 6

This example demonstrates that USY may be replaced by another large pore siliceous zeolite. The catalyst composition is similar to that of Example 3, but zeolite Beta is used in place of USY. The catalyst contains approximately 40 wt. % zeolite.

When the heavy feed used in Example 3 is processed under the same conditions over this NiMo/Beta catalyst at 700° F., 37% of the material boiling above 630° F. is converted to lighter hydrocarbons, and selectivity to 420°–630° F. distillate is 85%. At 750° F., conversion is 51% and selectivity is 76%.

What is claimed is:

1. A process for hydroprocessing, in a plurality of reaction zones, a feed comprising a refinery distillate stream having an aromatic content of at least 40%, the stream boiling in the range between 300° and 900° F., the process comprising the following steps.

(a) separating the stream by fractionation into at least two fractions having different boiling ranges, the first fraction having an initial boiling point of between 300° F. and 400° F. and an endpoint in the range between about 500° and 700° F., the second fraction having an initial boiling point in the range between about 500° to 675° F. and an endpoint between 750° and 900° F., and wherein said first fraction contains from 0.1 to 5 wt. % dibenzothiophene, substituted dibenzothiophenes, and heavier polycyclic thiophenes;

(b) passing the first fraction to a first reaction zone, where it is contacted under hydrotreating conditions with a hydrotreating catalyst and an excess of hydrogen thereby obtaining a first effluent which contains less than 0.3 wt % S;

(c) passing the second fraction to a second reaction zone, were it is contacted under hydroprocessing conditions, the hydroprocessing conditions comprising a total pressure between about 600 and 2000 psig, a hydrogen circulation rate between about 1000 and 8000 SCF/B, a reaction temperature between 500° and 800° F. and a WHSV from about 0.5 to 5 hr–1, with a catalyst comprising a hydrogenation component and an active acidic material having a Constraint Index which is less than 2, wherein the active material is a highly siliceous zeolite or an amorphous silica-alumina material having an acidic functionality, wherein the active material is selected from the group consisting of ZSM-4, ZSM-20, mordenite, REY, amorphous silica-alumina material, dealuminized Y, USY, and zeolite beta, to convert over 35% of the material boiling above about 630° F. in said second fraction to material boiling below 630° F., thereby obtaining a second effluent.

2. The process of claim 1, wherein the first fraction contains from 0.1 to 2 wt. % dibenzothiophene, substituted dibenzothiophenes, and heavier polycyclic thiophenes.

3. The process of claim 1, wherein the first fraction contains from 0.1 to 1 wt. % dibenzothiophene, substituted dibenzothiophenes, and heavier polycyclic thiophenes.

4. The process of claim 1, wherein at least 45% of the material boiling above 630° F. in said second fraction is converted to lower boiling products.

5. The process of claim 1, wherein the material boiling above 630° F. in the second fraction is recycled to extinction through the second reaction zone.

6. The process of claim 1, wherein the first fraction has an initial boiling point of at least about 300° F. and an endpoint in the range between about 550° and 675° F., and the second fraction has an initial boiling point in the range between about 500° and 650° F. and an endpoint of between 800° and 900° F.

7. The process of claim 1, wherein the first fraction has an initial boiling point of at least 300° F. and an endpoint in the range between about 600° and 650° F., and the second fraction has an initial boiling point in the range between about 500° and 650° and an endpoint of between about 750° and 850° F.

8. The process of claim 1, wherein the hydrotreating catalyst of step (b) comprises a hydrogenation component of at least one transition metal of Group VIA or Group VIIIA.

9. The process of claim 1, wherein the hydrotreating conditions of step (b) comprise a pressure in the range from 300 to 1000 psig, a hydrogen circulation rate from 500 to 6000SCF/B, a reaction temperature from 400 to 800° F. and a WHSV from about 0.5 to 6 hr–1.

10. The process of claim 1, wherein the feed has an aromatic content of at least 60 wt %.

11. The process of claim 10, wherein the feed has an aromatic content of at least 80 wt %.

12. The process of claim 1 in which the feed has an API gravity from 5 to 25.

13. The process of claim 12, in which the feed has a hydrogen content from 8.5 to 12.5 wt %.

14. The process of claim 1, in which the catalyst of step (c) comprises at least one transition metal of Group VIA or Group VIIIA as the hydrogenation component.

15. The process of claim 1, wherein the highly siliceous zeolite possesses a silica:alumina ratio in the range of from 5:1 to 200:1.

16. The process of claim 1, wherein the catalyst of step (c) further comprises a binder composed of a non-acidic amorphous inorganic oxide material.

17. A process for hydroprocessing, in a plurality of reaction zones, a feed comprising a refinery distillate stream having a high aromatic content, the stream boiling in the range between 300° and 900° F., the process comprising the following steps:

(a) separating the stream by fractionation into at least two fractions having different boiling ranges, the first fraction having an initial b oiling point of between about 300° F. and 400° F. and an endpoint in the range between about 500° and 700° F., the second fraction having an initial boiling point in the range between about 500° and 675° F. and an endpoint of between about 750° and 900° F. and wherein the first fraction contains from 0.1 to 5 wt % of dibenzothiophene, substituted dibenzothiophenes and heavier polycyclic thiophenes.

(b) passing the first fraction to a first reaction zone, where it is contacted under hydrotreating conditions with a hydrotreating catalyst and an excess of hydrogen to obtain a first effluent which contains less than 0.03 wt % S;

(c) passing the second fraction to a second reaction zone, where it is contacted under hydrotreating conditions with a hydrotreating catalyst and an excess of hydrogen thereby obtaining a second effluent;

(d) passing the effluent of step (c) to a third reaction zone, where it is contacted under hydroprocessing conditions the hydroprocessing conditions comprising a total pressure between about 600 and about 2000 psig, a hydrogen circulation rate between about 1000 and 8000 SCF/B, a reaction temperature between 500° and 800° F., and a WHSV from about 0.5 to 5 hr–1, with a catalyst comprising a hydrogenation component and an acidic active material having a Constraint Index which is less than 2, wherein the active material is a highly siliceous zeolite or an amorphous silica-alumina material having an acidic functionality, wherein the active material is selected from the group consisting of ZSM-4, ZSM-20, mordenite., TEA mordenite, REY, amorphous silica-alumina material, delauminized Y, USY and zeolite beta , to convert over 35% of the material boiling above about 630° F. in second effluent to material boiling below about 630° F., thereby obtaining a third effluent.

18. The process of claim 17, wherein the hydrotreating conditions of step (b) comprise a pressure in the range from 900 to 1500 psig, a hydrogen circulation rate from 2000 to 5000 SCF/B, a reaction temperature from 600° to 750° F. and a WHSV from about 1 to 4 hr–1.

19. The process of claim 17, wherein the hydrotreating catalyst of steps (b) and (c) comprises a hydrogenation component of at least one transition metal of Group VIA or Group VIIIA.

* * * * *